US007422125B2

(12) United States Patent
Winberg

(10) Patent No.: US 7,422,125 B2
(45) Date of Patent: Sep. 9, 2008

(54) BLISTER PACKAGE

(76) Inventor: Ragnar Winberg, Silvakragatan 87, 254 58 Helsingborg (SE)

( * ) Notice: Subject to any disclaimer, the term of this patent is extended or adjusted under 35 U.S.C. 154(b) by 317 days.

(21) Appl. No.: 11/301,005

(22) Filed: Dec. 12, 2005

(65) Prior Publication Data

US 2006/0086642 A1 Apr. 27, 2006

Related U.S. Application Data

(62) Division of application No. 10/471,435, filed on Sep. 10, 2003, now abandoned.

(51) Int. Cl.
*B65D 83/04* (2006.01)

(52) U.S. Cl. ..... 220/359.1; 206/469; 206/532

(58) Field of Classification Search ..... 206/538, 206/541, 542, 469, 438, 467, 532, 539; 220/359.1, 220/359.2, 359.4
See application file for complete search history.

(56) References Cited

U.S. PATENT DOCUMENTS 3,283,885 A * 11/1966 Grunewald et al. ..... 206/532
3,635,376 A * 1/1972 Hellstrom ..... 222/107
3,811,564 A * 5/1974 Braber ..... 206/469
3,812,963 A * 5/1974 Zahuranec et al. ..... 206/468
3,872,970 A * 3/1975 Edison ..... 206/532
3,905,479 A * 9/1975 Gerner et al. ..... 206/531
3,921,805 A * 11/1975 Compere ..... 206/532
3,933,245 A * 1/1976 Mullen ..... 206/532
3,941,248 A * 3/1976 Moser et al. ..... 206/531
RE29,705 E * 7/1978 Compere ..... 206/531
4,155,454 A * 5/1979 Ryden ..... 206/532
4,243,144 A * 1/1981 Margulies ..... 206/532
4,294,361 A * 10/1981 Margulies et al. ..... 206/532
4,305,502 A * 12/1981 Gregory et al. ..... 206/532
4,316,541 A * 2/1982 Braverman et al. ..... 206/532
4,865,217 A * 9/1989 Yoshimoto ..... 220/266
5,178,293 A * 1/1993 Suzuki et al. ..... 220/359.3
5,325,968 A * 7/1994 Sowden ..... 206/532
5,360,116 A * 11/1994 Schmiletzky ..... 206/531
5,538,129 A * 7/1996 Chester et al. ..... 206/63.5
5,613,609 A * 3/1997 Hamilton et al. ..... 206/531
5,727,687 A * 3/1998 Renner ..... 206/532
5,775,505 A * 7/1998 Vasquez et al. ..... 206/538
5,833,071 A * 11/1998 Ray ..... 206/532
5,862,915 A * 1/1999 Plezia et al. ..... 206/528
6,036,016 A * 3/2000 Arnold ..... 206/532
6,085,942 A * 7/2000 Redmond ..... 222/107

(Continued)

*Primary Examiner*—Anthony D Stashick
*Assistant Examiner*—James N Smalley
(74) *Attorney, Agent, or Firm*—Rolf Fasth; Fasth Law Offices

(57) ABSTRACT

The package includes a first foil (1) that has a plane upper side that surrounds at least one hollow (2). The package includes a lid of a second foil (3), which can be split open, for every hollow, attached to the upper side where every lid has a flap (4). The lid can be split open, where the flap consists of the first foil (1) and the second foil (3) attached to each other and where in the first foil there is a straight cut (9) which separates the flap from the remaining part of the first foil. The cut (9) is on the upper side of the first foil. The cut does not go entirely through the foil and where the cut, when the flap is strongly bent down, is widened so that the first foil breaks after which the lid (3) can be split open.

6 Claims, 2 Drawing Sheets

U.S. PATENT DOCUMENTS 6,161,699 A * 12/2000 Gartland ..... 206/531
6,244,442 B1 * 6/2001 Inoue et al. ..... 206/531
6,523,691 B2 * 2/2003 Raj et al. ..... 206/538
6,776,285 B2 * 8/2004 Shibata ..... 206/469

* cited by examiner

BLISTER PACKAGE

PRIOR APPLICATIONS

This is a divisional patent application that claims priority from U.S. national phase patent application Ser. No. 10/471,435 filed 10 Sep. 2003 now abandoned.

BACKGROUND AND SUMMARY OF THE INVENTION

The present invention concerns a package which is especially suitable for medical tablets an (capsules. The since long most common type of medical tablets packed by the piece is such blister packages where the tablets are pressed out by pressing the blister bubble so that the lid covering the blister gives way and the tablet comes out through the broken lid. Especially for old people and disabled persons tablets from these blisters can be difficult to press out. The easier they are to press out for everybody the easier they will also be for small children to press out. On a partly used blister a child can easily see that some blister bubbles have been pressed out. It is therefore easy for a child to understand that to get hold of a tablet you must press the bubble so that the lid gives way and the tablet is free. This type of blisters is therefore less childproof. Of course child safety increases if the bubble is of a thick and stiff material but then it will also be more difficult to press out for grown-ups.

Another type of blister for medical tablets is described in the Swedish Patent 513 535. Here a lid is split open by pulling a flap directly. Also this can be understood by a little child. This package is therefore not especially childproof either.

The present invention concerns a package where greater security in preventing small children from opening it is obtained but without becoming difficult to open for people who understand how to open it.

The invention will be described in detail in the following with the help of figures which show examples of the invention. Certain measures have been exaggerated for the sake of clarity.

DETAILED DESCRIPTION

Figure 1:
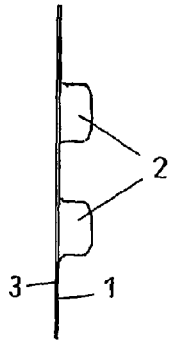
FIG. 1 shows a package seen from one side.
Figure 2:
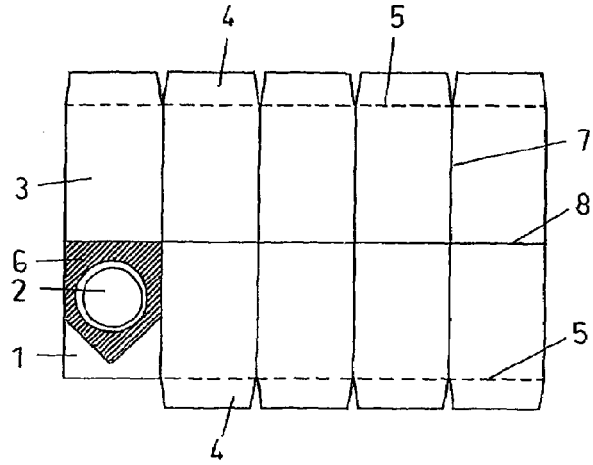
FIG. 2 shows the package according to FIG. 1 seen from above.

In the figures a relatively thick and stiff first foil is indicated by reference number 1. From these hollow spaces or bubbles 2, in which tablets are to be kept, tables may be pressed out in a well-known manner. The first foil has a plane upper side which surrounds every hollow. The plane upper side is entirely covered by a thin second foil 3 which can be split open, forming a lid over the hollows. The second foil has been pulled off one of the ten hollows in FIG. 2. The flaps are indicated by 4 and are the material which is outside the broken lines 5 in FIG. 2. The shaded area 6 in FIG. 2 is where the second foil is attached to the upper side of the first foil 1 where it can be split open. The second foil has been cut through along the lines 7 and 8.

Figure 3:
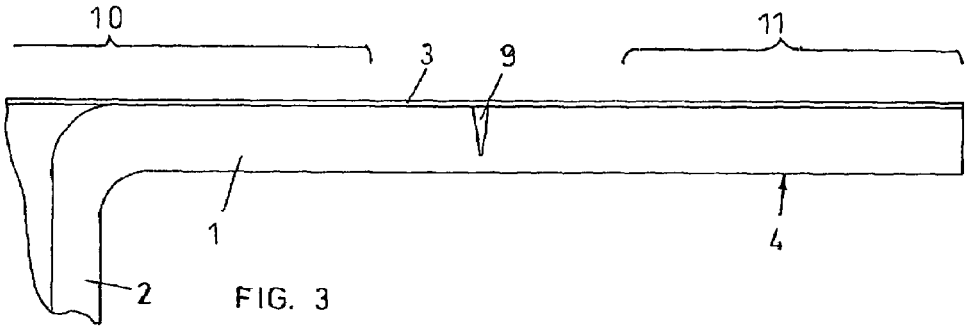
FIG. 3 shows enlarged the combination of a flap with the remaining lower part of the package.
Figure 4:
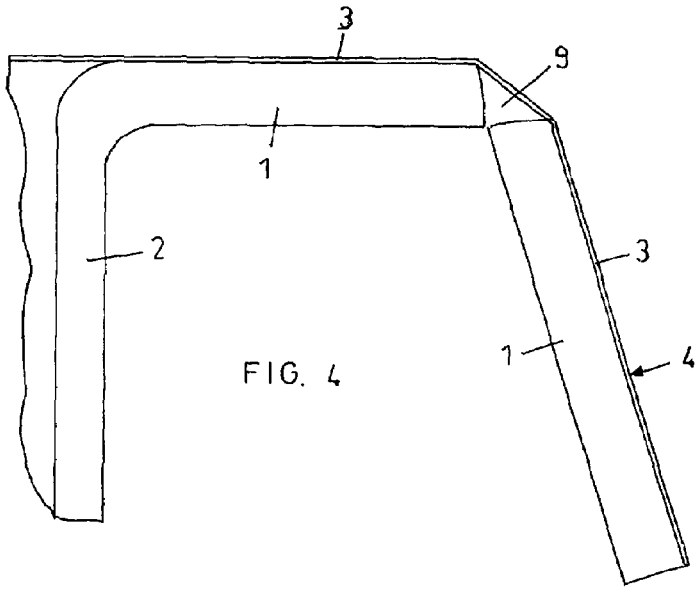
FIG. 4 shows the flap according to FIG. 3 but bent downwards.

A cut 9 has been made in the first foil before the second foil has been applied thereon. The cut in FIGS. 3 and 4 corresponds to the broken lines 5 in FIG. 2. The cut separates the flap from the remaining part of the first foil. The cut does not go entirely through the first foil 1, which is clearly shown in FIG. 3. In FIGS. 3 and 4, the second foil is not attached close to the cut but only in the areas 10 and 11 beside the cut.

When the second foil is split open, that is the opening of the lid over a hollow (bubble), the flap must first be bent downwardly, as is shown in FIG. 4. When bent down enough the remaining material gives way below the cut 9. When this has given way entirely, the flap can be bent upwards and the second foil (the lid) be split open. When the first foil is bent down, the second foil is stretched over the more and more widened cut. This is possible if the second foil can be stretched a little and if it is not attached close to the cut but can be stretched in the area between 10 and 11 where it has been attached. If the second foil is un-elastic for instance because it contains an aluminum foil, it can be attached in area 11 with self-adhesive glue. Then the second foil can glide on the glue here.

Figure 5:
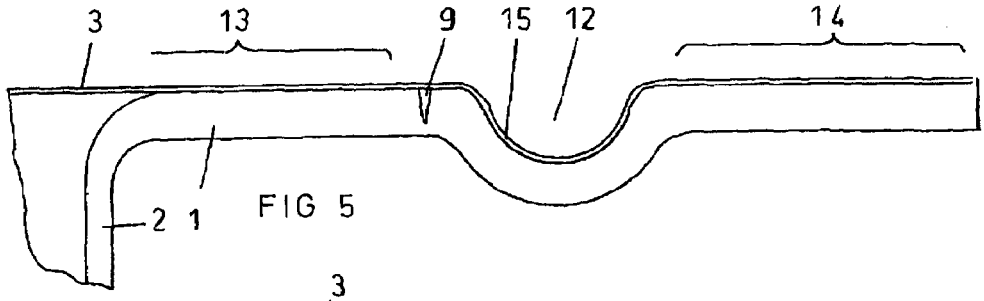
FIG. 5 shows enlarged a second version of a flap.
Figure 6:
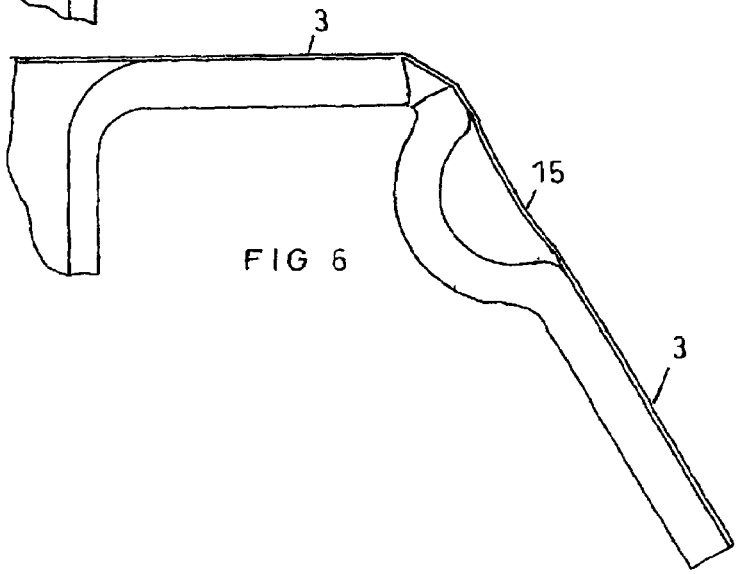
FIG. 6 shows the flap according to FIG. 5 but bent downwardly.

Other ways of using an un-elastic second foil are shown in FIGS. 5-8. FIGS. 5 and 6 each shows that the first foil and the second foil have been formed to a hollow 12 that is parallel with the cut. Here the two foils have been welded together in the areas 13 and 14. They have not been welded together over the cut and the hollow. When the flap is bent down, the material 15 of the second foil is stretched in the hollow, which is clearly shown in FIG. 6.

Figure 7:
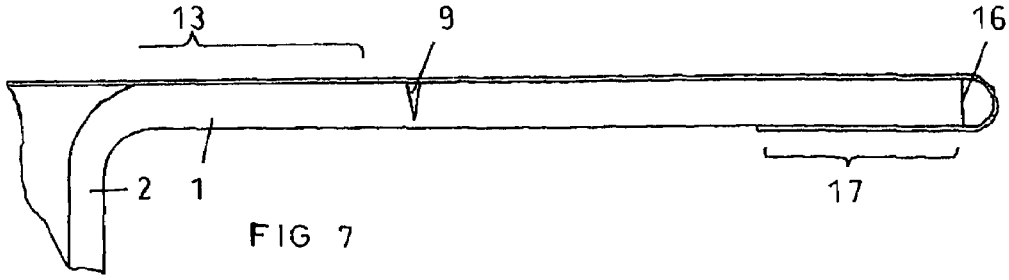
FIG. 7 shows a third version of the flap.

In FIG. 7 is shown that the second foil 3 is bent around the outer edge 16 of the first foil, and only outside the cut is welded together with the first foil in the bent part 17 and that the bending goes so much outside the outer edge 16 of the first foil that the second foil is sufficient to prevent the flap from bending downwards as much as is required for the first foil to split at the cut.

Figure 8:
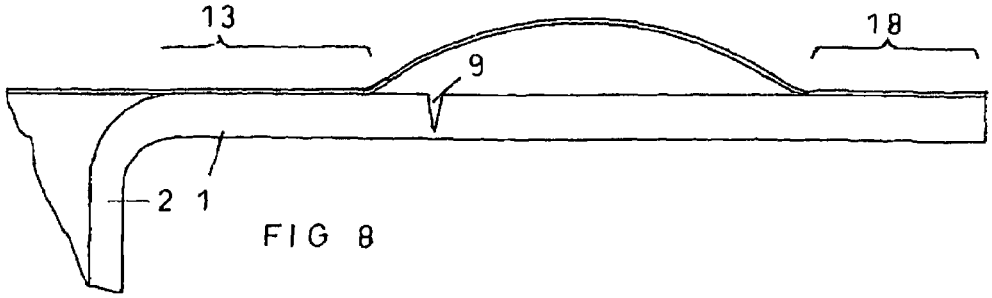
FIG. 8 shows a fourth version of the flap.

In FIG. 8 is shown that the second foil 3 has been welded to the first foil 1 outside the cut and that the second foil inside this welding area 18, measured at right angles to the cut, is longer than the first foil.

A written instruction on the package or on a box containing the package can say that the flap must first be bent down before the lid can be split open. This will not be understood by those who are uninitiated and cannot read. Therefore the design of this package is more childproof than earlier models. No great strength is needed to open it and therefore it ought not to be difficult for an initiated person to do so.

The invention claimed is:

1. A method of opening a package, comprising:

providing a first foil having a plane upper side, the first foil having at least one cavity defined therein by a bulge segment of the first foil so that the first foil surrounds the cavity, the package having a lid of a second foil attached to the upper side, wherein every lid has a separate flap where each flap consists of the first foil and the second foil attached to each other and wherein in the first foil there is a straight cut defined therein which separates the flap from a remaining part of the first foil, the cut being disposed outside the cavity and remote from the bulge segment, the cut being on the upper side of the first foil, the cut not going entirely through the first foil, the second foil not being attached to the first foil close to the cut, bending the flap in a first direction to widen the cut until the cut has penetrated the first foil, while bending the flap in the first direction, stretching the second foil across the widened cut without breaking the second foil, bending the flap in a second direction that is opposite the first direction, breaking the first foil at the cut, separating the flap from the first foil in an area disposed between the cut and the bulge segment, pulling the flap across the bulge segment to open the bulge segment.

2. The method according to claim 1, wherein the method further comprises the first foil and the second foil have a common contour.

3. The method according to claim 1, wherein the method further comprises extending the first foil around the entire bulge segment.

4. The method according to claim 1, wherein the method further comprises disengaging an outer portion of the first foil, that is part of the flap, from an inner portion of the first foil disposed between the cut and the bulge segment.

5. The method according to claim 1, wherein the method further comprises exposing an inside of the bulge segment as the second foil is pulled over the bulge segment.

6. The method according to claim 1 wherein the method further comprises separating the second foil from the first foil prior to pulling the second foil across the bulge segment.

* * * * *